US006142694A

United States Patent [19]

Rivlin et al.

[11] Patent Number: 6,142,694

[45] Date of Patent: Nov. 7, 2000

[54] TOOTHBRUSH WITH RESERVOIR FOR DENTIFRICE

[76] Inventors: Eitan Rivlin, Rehov Béerot 21, Givat Zeev 90917; Yonatan Goldstein, Rehov Chaim Vital 33, Jerusalem 95470, both of Israel

[21] Appl. No.: 09/445,505

[22] PCT Filed: Jun. 7, 1998

[86] PCT No.: PCT/IL98/00264

§ 371 Date: Dec. 9, 1999

§ 102(e) Date: Dec. 9, 1999

[87] PCT Pub. No.: WO98/56277

PCT Pub. Date: Dec. 17, 1998

[30] Foreign Application Priority Data

Jun. 12, 1997 [GB] United Kingdom ..... 9712137

[51] Int. Cl.[7] ..... B43K 5/06

[52] U.S. Cl. ..... 401/181; 401/171; 401/269

[58] Field of Search ..... 401/171, 176–179, 401/182, 270, 277, 181, 269; 222/387, 388, 392

[56] References Cited

U.S. PATENT DOCUMENTS

| | | | |
|---|---|---|---|
| 4,521,128 | 6/1985 | O'Neal | 401/269 |
| 4,917,273 | 4/1990 | Seager | 222/392 |

FOREIGN PATENT DOCUMENTS

| | | | |
|---|---|---|---|
| 1219877 | 12/1960 | France | 401/181 |
| 424156 | 12/1960 | Italy | 401/181 |

*Primary Examiner*—Henry J. Recla
*Assistant Examiner*—Tuan Nguyen
*Attorney, Agent, or Firm*—Edward Langer

[57] ABSTRACT

A disposable toothbrush with a built-in reservoir (2) for dentifrice including a piston (18), a cord (16), and a rotatable spindle (21) for forcing the dentifrice from the storage compartment through a conduit (7) in the neck portion (6) to the bristles (10) in a controlled manner.

13 Claims, 3 Drawing Sheets

TOOTHBRUSH WITH RESERVOIR FOR DENTIFRICE

FIELD OF INVENTION

The present invention relates to an improved tooth brush with a built-in reservoir for dentifrice More particularly the present invention relates to a disposable tooth brush of the aforementioned type, of economical construction, with a simple, compact and effective means of manually supplying toothpaste, gel , mouthwash or other dentifrice to the brushhead and bristles.

BACKGROUND OF THE INVENTION

Toothbrushes having a built-in reservoir for toothpaste have been previously suggested as a means for combining the features of toothbrush and toothpaste, thereby avoiding the need for carrying around or having available two separate items, the toothbrush and the toothpaste. Such a combination is considered of particular use for travelers, businessmen, children and holiday makers. Ideally such a combination, if designed correctly, would have intrinsic attractiveness and convenience attributes. Such aesthetic properties would encourage widespread use initially by people on the move, ultimately being adopted by the general population.

A survey of the prior art shows that previous inventions lack simplicity, convenience and cost effectiveness.

Thus in U.S. Pat. No. 5,026,191 to Akly, toothpaste is stored in the hollow handle of the brush and is made to flow out at the brushhead near the base of the bristles by turning a knob mounted at the opposite end of the toothbrush furthest away from the brushhead. The knob is fixed to a threaded rod mounted in the center axis of the hollow handle and when rotated causes a follower on the threaded rod to advance and force the paste via a connecting conduit in the neck and head of the brush out to the bristles. The follower is fitted with key ways, and the storage compartment corresponding key tracks, in order to prevent the follower rotating when the knob is turned. In one particular embodiment the toothpaste compartment is closed off from the conduit connecting with the brushhead by seal or valve means, such means requiring opening the seal or valve before the toothbrush can be used. Alternatively the toothbrush can be made disposable.

There are two main drawbacks with the Akly patent. Firstly, mounting the knob at the opposite end of the toothbrush (furthest from the brushhead) implies that inconvenient two-handed operation of the device will be required. The user will have to grip the toothbrush with one hand while activating the knob with the other hand. Secondly, the fact that the follower in the toothpaste compartment is mounted on a threaded rod and is fitted with key ways to prevent it rotating when the knob is turned, make sealing off and retention of the toothpaste in the storage compartment by the follower very difficult to ensure and maintain. During operation of the knob, the imperfect sealing is likely to result in leakage of toothpaste beyond the follower, either via the center hole or periphery of the follower, with consequent waste of material.

Benichou in French patent 2,592,287 disclosed a disposable toothbrush incorporating dentifrice in the handle. In this device a miniature pump, actuated hydraulically by pressing a button projecting from the end of the handle nearest the brushhead, and located in a double walled dentifrice storage compartment, causes a portion of dentifrice to emerge from the brushhead (at the bristles) via a conduit in the brush neck and brushhead. Although this disclosure does offer the convenience of operation using one hand, there are two main drawbacks. The miniature pump assembly is complex, with many moving parts, making the device uneconomical. Secondly, the need for the double wall dentifrice storage compartment and the appreciable volume of the pump itself greatly detract from the available volume of dentifrice that can be carried in a practically sized handle. For example a storage compartment of only 9 mm diameter and a dentifrice volume of only 1.5–4.5 cc are specifically referred to.

Since a dentifrice volume of 0.2 cc per teeth cleaning operation is normally required it is clear that the Benichou brush will only allow upto 22 cleaning operations. Not only is the device uneconomical, but it will only last a few applications before it must be discarded.

Laila B. Moussa in U.S. Pat. No. 5,439,014 discloses a refillable toothbrush with a liquid toothpaste reservoir. The handle of the brush is fitted with a flexible bellows and the toothbrush head with minute holes. When the bellows is depressed liquid toothpaste emerges onto the brushhead and by inverting the toothbrush so the brushhead is topmost the air pressure is balanced and the bellows re-expands. This invention has the drawback of being limited to use of a liquid dentifrice which lacks the superior teeth cleaning ability of other types. The device is cumbersome in operation since it relies on holding the toothbrush in a particular orientation during depression of the bellows, and the dentifrice may tend to dry out and block the minute delivery holes.

DESCRIPTION OF THE PRESENT INVENTION

The present invention offers a means for overcoming the limitations of the prior art by introducing improved means for forcing dentifrice from the storage compartment through a conduit in the neck portion to the bristles in a controlled manner at will, where said improvement includes:

a rotatable spindle mounted inside the storage compartment near the neck section, sealably protruding through at least one wall of said compartment, terminating in a grippable head situated outside the storage compartment, by means of which the spindle may be rotated, a length of cord fixed and wound on the spindle, said cord passing through the storage compartment and enclosed dentifrice, said cord being fixed at its other end to a piston having a similar cross section to that of the hollow handle interior, said piston situated at the end of the storage compartment remote from the brushhead, and fitted so as to seal and prevent dentifrice from escaping beyond said piston, said piston moving forward by the pulling action of the connecting cord when the grippable head and spindle are rotated, thereby forcing dentifrice from the storage compartment into the conduit and out to the head portion and bristles.

Towards the accomplishment of these means this invention may be embodied in the form illustrated in the accompanying drawings. It should be understood that these drawings are illustrative only, and that changes may be made in the specific construction illustrated and described within the scope of the appended claims.

Figure 3:
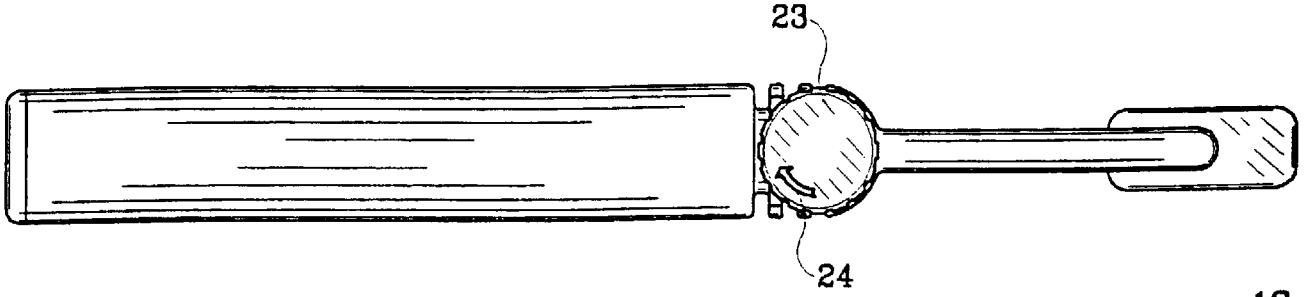
FIG. 3 is a bottom view, with the bristles turned away from the observer
Figure 1:
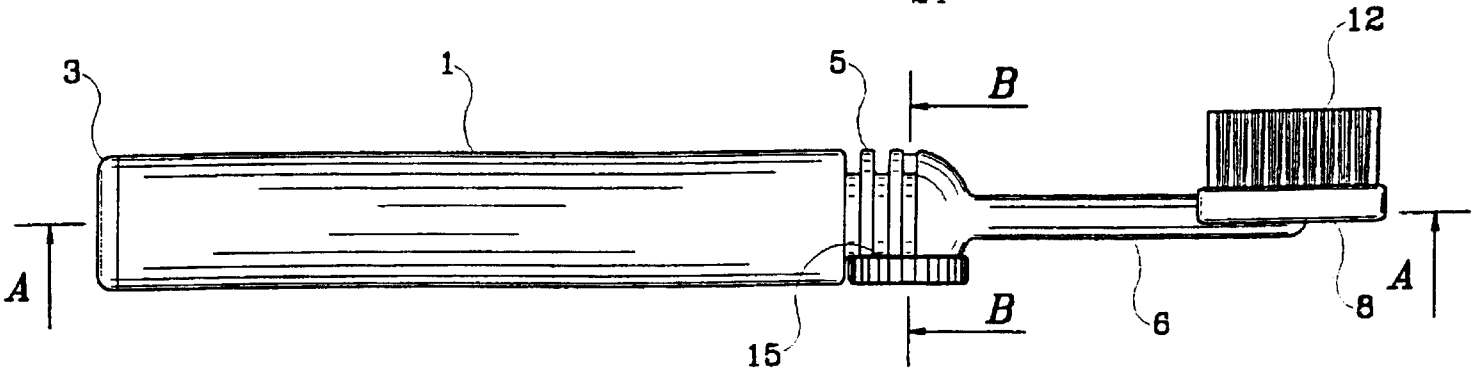
FIG. 1 is a front view of the toothbrush, with the bristles perpendicular to the line of sight of the observer
Figure 2:
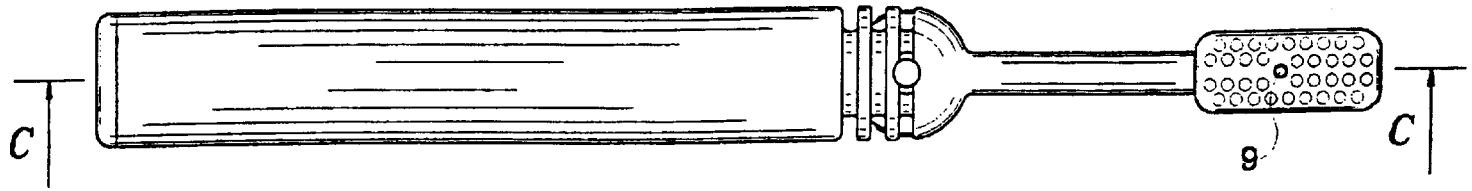
FIG. 2 is a top view, with the bristles turned towards the observer
Figure 5:
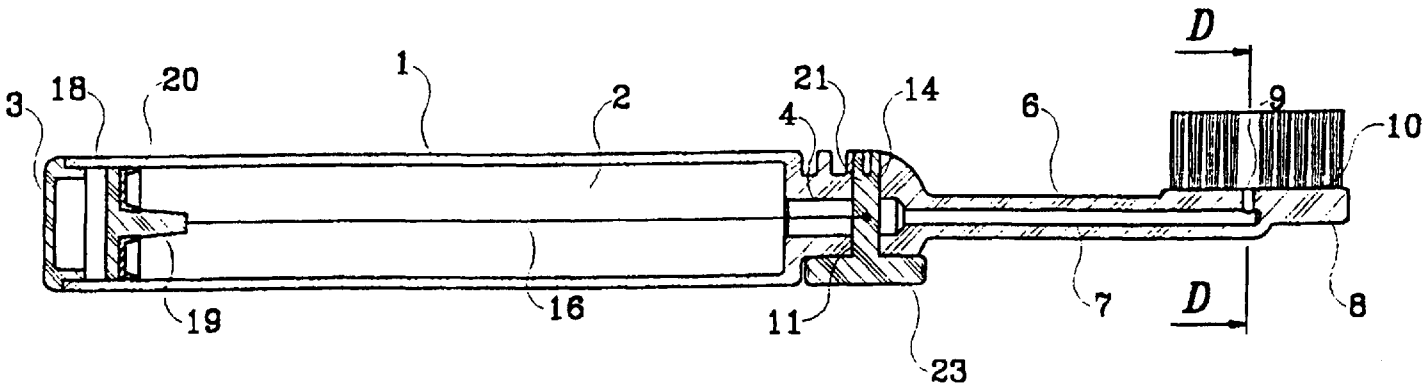
FIG. 5 is a longitudinal section view, along line C—C in FIG. 2, observation as in FIG. 1
Figure 4:
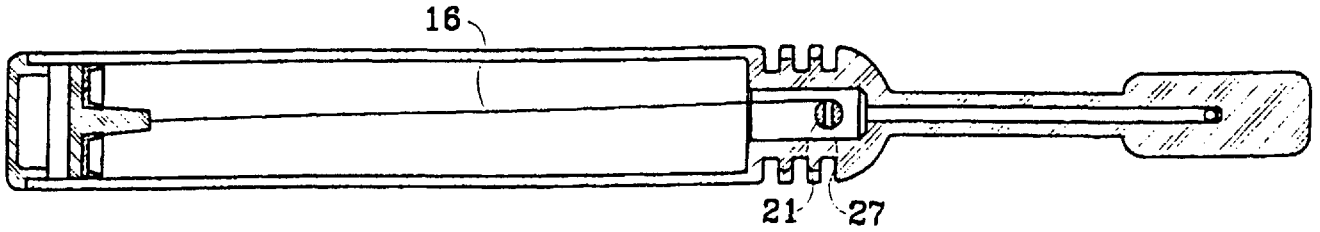
FIG. 4 is a longitudinal section view, along line A—A in FIG. 1, observation as in FIG. 3
Figure 7:
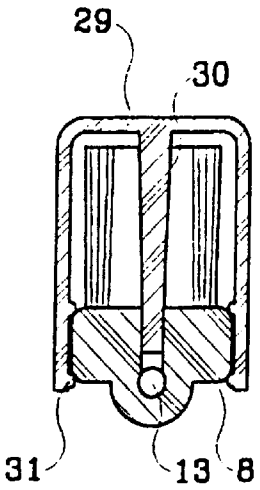
FIG. 7 is a transverse section view, through the brushhead taken along the line D—D in FIG. 5 including an optionally cover and inbuilt seal.
Figure 6:
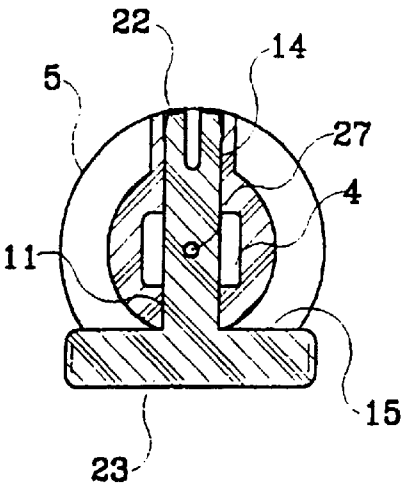
FIG. 6 is a transverse section view, taken along the line B—B in FIG. 1
Figure 8:
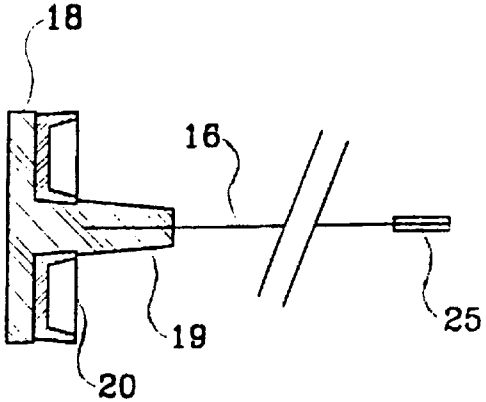
FIG. 8 is a section through the piston and anchor showing part of the cord.

As shown in FIGS. 1 to 8, the toothbrush with reservoir for dentifrice consists of a rigid hollow cylinder 1 of plastic, comprising the dentifrice storage compartment 2 and serving as a handle for holding the toothbrush. Suitable materials for this unit are polystyrene, ABS, SAN, polycarbonate, polyethylene, polypropylene and acrylic, in either transparent, translucent or opaque form. This storage compartment having a fixed cross section, for example cylindrical, contains a suitable dentifrice such as toothpaste, gel or mouthwash, and is optionally fitted at one open end with a stopper 3. In one embodiment, the stopper or the handle section near the stopper can be fitted with a clip for conveniently carrying the toothbrush, for example in a shirt pocket. At its other end the cylinder narrows internally to a short end section 4 and correspondingly its outer surface is provided with stubby ribs 5 to enhance gripping when the device is held in one hand.

The hollow handle portion continues into a long rigid and narrow neck section 6 with an internal conduit 7 through which the dentifrice can flow. The neck section terminates with the brushhead 8 and the conduit continues into the dentifrice delivery orifice 9 through which dentifrice can be delivered into the base of the bristles 10 . A plurality of delivery orifices may be employed in the brushhead also. The brushhead is optionally fitted with a removable cap 29 which may be inserted by snap action of the protrusions 31 in the cap. This cap is advantageously provided with a centrally mounted projecting rod 30 or rods such that when in place on the brushhead the orifice or orifices normally providing dentifrice to the bristles 12 are sealed by the rod or rods. By this means the brushead is protected from dirt and the dentifrice from germs and drying out.

The simple mechanism for delivery of dentifrice to the brushhead can now be described with particular reference to FIGS. 4 to 8.

Situated immediately before the beginning of the neck section is a hole 11 passing through one of the walls of the narrow end section 4. Into this hole is inserted a plastic spindle 21, preferably with flexible finger-like extensions 22 at one end, carrying at its other end an externally mounted grippable head 23, for example a knurled wheel. The flexible finger-like extensions at the end of the spindle protrude through a stepped hole 14 in the opposite wall of the narrow end section 4 and spring open into the larger diameter section of the hole 14 in a snap action, avoiding the possibility of the spindle being pulled out of position. The spindle and its mounting holes have close tolerances and effectively seal the storage compartment so that dentifrice will not escape past the mounting holes. Suitable materials for the spindle are polycarbonate, polyethylene, polypropylene and acetal.

Advantageously, the wheel 23 is made flush with the rigid cylinder I by means of an external recess 15 in the outer wall, in order to maintain a streamlined and compact appearance for the device. The spindle 21 has wound upon it a length of connecting cord 16 which is looped, knotted or anchored, for example by an anchor 25, at one end in a hole 27 in the spindle. Other means of securing the cord to the spindle such as a hook which locks into the hole in the spindle, can also be used. Examples of suitable cords are synthetic materials such as polyester, nylon, aramid, teflon and kevlar, natural materials such as cotton and wool, and metals such as aluminum and stainless steel.

The other end of the cord is attached to a rigid piston 18 which has a similar cross section as the dentifrice storage compartment. Preferably the cord is integrally molded into the piston during the injection moulding process. This piston can sealably traverse the whole length of the dentifrice storage compartment when the cord is pulled. The piston has a reduced diameter projecting axial section 19 which acts to push the final quantity of dentifrice out of the narrow end section 4 when the plunger reaches the end of its traverse. Furthermore, the piston is advantageously fitted with an elastomeric seal 20 on the side facing the dentifrice in order to seal off the dentifrice storage compartment and prevent dentifrice escaping past the plunger when the plunger advances. Suitable elastomer materials are soft plastics such as acetal and polypropylene, or rubbers such as nitrile, EPDM, silicones and fluoroelastomers.

The operation of the mechanism for forcing dentifrice to the brushhead in the toothbrush incorporating dentifrice may now be described.

The toothbrush would be advantageously marketed in a sealed blister type package. Once this package is removed the toothbrush would be grasped by the handle in one hand and rotation of the grippable head 23 between finger and thumb carried out, in a preferred direction indicated by a suitable means for example an arrow 24 marked on the wheel.

The rotation of the spindle will take up cord and draw the piston 18 along the preferred cylindrical dentifrice storage compartment. Dentifrice would be forced through the neck conduit and emerge through the dentifrice delivery hole 9 or holes at the base of the bristles 10 of the brushhead. The quantity of dentifrice emerging is easily controllable and is proportional to the degree of rotation of the wheel. Apart from the compact, simple and lightweight features of the toothbrush, as well as the convenience of one hand operation, it should be appreciated that most of the length and volume of the storage compartment is available for storing dentifrice. This insures a good dentifrice volume capacity for the device. A typical capacity for a device of this type having a total length similar to a conventional toothbrush would be about 20 cc of dentifrice. At the previously referred to dosage of 0.2 cc per application there would be enough dentifrice in the toothbrush for about a hundred applications before replacement, a significant advantage over prior art systems.

A further advantage of the device is that the handle, neck and brushhead sections are all one molded piece allowing for low cost manufacturing.

In other embodiments of the invention the brushead assembly is made removeable from the handle section by either screw or press-on means, enabling the same brushhead to serve more than one handle section, or enabling change during use of different brushes or brush types.

Optionally the storage compartment can also be made the element that is replaced.

While certain novel features of this invention have been shown and described and pointed out in the above text and the annexed claims, it will be understood that various omissions, substitutions and changes in the forms and details of the device illustrated and in its operation can be made by those skilled in the art without departing from the spirit of the invention.

We claim:

1. A disposable toothbrush with a reservoir for dentifrice comprising, a. an elongated hollow handle portion, open at one end, of which the internal volume, having a fixed cross section, serves as a storage compartment for dentifrice, b. a toothbrush head portion with a plurality of bristles thereon, having a conduit therein, and at least one orifice opening from said conduit towards the bristles, said head portion being connected to said handle portion via c. a neck section having a common conduit therein, open to said handle storage compartment at one end, and to said conduit in said head portion at its other end, such that dentifrice can pass via said conduit from said storage compartment through said neck section to said head portion and said bristles, d. said handle, neck section and head portion being formed in one molded piece, e. means for forcing dentifrice from said storage compartment through said conduit to said bristles in a controlled manner, where said means include, f. a rotatable spindle mounted inside said storage compartment near said neck section, sealably protruding through at least one wall of said compartment, terminating in a grippable head situated in a recess outside said storage compartment and flat with the outer surface of said compartment, whereby said spindle may be rotated, g. a length of cord fixed and wound on the spindle, said cord passing through said storage compartment and enclosed dentifrice, being fixed at its other end to h. a piston having a similar cross section to that of a hollow handle interior, situated at the end of said storage compartment remote from said head portion, fitted so as to seal and prevent dentifrice from escaping beyond said piston, said piston moving forward by the pulling action of the connecting cord when said grippable head and spindle are rotated, thereby forcing dentifrice from said storage compartment into said conduit and out to said head portion and bristles, the front of said piston having a projecting portion of reduced cross section, which can enter the narrow internal volume of the spindle portion at the end of travel of the piston to efficiently empty the final volume of dentifrice, and i. a stopper fitted at the open end of said brush handle after said piston is in place.

2. A toothbrush as in claim 1 wherein the dentifrice is toothpaste, gel or mouthwash.

3. A toothbrush as in claim 1 wherein said piston is rigid and has an elastomeric sealing ring attached to it.

4. A toothbrush as in claim 1 wherein said hollow handle internal cross section is cylindrical in shape.

5. A toothbrush as in claim 1 wherein said grippable head is configured as a knurled wheel in shape.

6. A toothbrush as in claim 1 wherein said cord is integrally molded into said piston to form a single unit.

7. A toothbrush as in claim 1 wherein said spindle with grippable head is secured in position by elastic finger-like extensions at the section opposite to said grippable head.

8. A toothbrush as in claim 1 wherein the end of said handle section close to said neck section is provided with gripping stubs.

9. A toothbrush as in claim 1 wherein said spindle has a centrally positioned hole in its cross section.

10. A toothbrush as in claim 9 wherein at the remote end from said piston said cord is integrally molded into an anchor with a similar diameter to said hole in said spindle.

11. A toothbrush as in claim 10 wherein said cord is locked onto said spindle by inserting said anchor into said spindle hole and by a rotation of at least 360°.

12. A toothbrush as in claim 9 wherein at the remote end from said piston said cord is integrally molded into a hook that locks into said hole in said spindle.

13. A toothbrush as in claim 1 wherein said cord is selected from the group of: polyester, nylon, aramid, teflon, kevlar, cotton, wool, aluminum, and stainless steel.

* * * * *